United States Patent [19]

Uchikawa et al.

[11] Patent Number: 4,770,925

[45] Date of Patent: Sep. 13, 1988

[54] THERMALLY BONDED NONWOVEN FABRIC

[75] Inventors: Akihiko Uchikawa; Koji Nishida; Yasuji Hosono; Kazuhisa Tachi; Takesi Okamoto, all of Yokkaichi; Yosuke Takai; Hideo Nakashima, both of Kako, all of Japan

[73] Assignees: Mitsubishi Petrochemical Co., Ltd., Tokyo; Daiwabo Co., Ltd., Osaka, both of Japan

[21] Appl. No.: 144,508

[22] Filed: Jan. 15, 1988

[30] Foreign Application Priority Data

Jan. 17, 1987 [JP] Japan ..... 62-8736

[51] Int. Cl.[4] ..... D04H 1/04

[52] U.S. Cl. ..... 428/219; 428/288; 428/296

[58] Field of Search ..... 428/288, 296, 219

[56] References Cited

U.S. PATENT DOCUMENTS 4,644,045 2/1987 Fowells ..... 428/287

*Primary Examiner*—Marion C. McCamish

*Attorney, Agent, or Firm*—Koda & Androlia

[57] ABSTRACT

There is provided a thermally bonded nonwoven fabric with a unit weight of 10 to 40 g/m$^2$, comprising 20 to 100% by weight of a composite fiber with a fineness of 0.5 to 8 denier and 80 to 0% by weight of other fibers as the constituent fibers, the composite fiber comprising a first component which is an ethylene-α-olefin copolymer composition comprising an ethylen-α-olefin copolymer containing 0.5 to 4% by weight of an α-olefin having 4 to 12 carbon atoms blended with 0.01 to 0.3% by weight of a phenol type antioxidant and 0.01 to 0.3% by weight of a sulfur type antioxidant, having a Q-value (weight average molecular weight/number average molecular weight) of 4 or less, a density of 0.930 to 0.950 g/cm$^3$, a melt flow rate of 5 to 50 g/10 min. and an oxidation induction time at 210° C. of 10 min. or longer, and a second component which is a thermoplastic resin having a melting point higher by at least 20° C. than that of the first component, with a constitutional ratio (sectional area ratio) of the first component to the second component being 35:65 to 70:30, said first component of the composite fiber forming at least a proportion of the fiber surface continuously along the length of each fiber and adhering through melting mutually the constituent fibers.

15 Claims, No Drawings

THERMALLY BONDED NONWOVEN FABRIC

BACKGROUND OF THE INVENTION

This invention relates to a thermally bonded nonwoven fabric and, more particularly, to a thermally bonded nonwoven fabric endowed with both high nonwoven fabric tenacity and soft hand formed of composite fibers excellent in spinnability, stretchability and also excellent in fusion bonding characteristics during formation into nonwoven fabric.

Nonwoven fabrics obtained by use of composite fibers comprising constituents with different melting points have been prepared by a process which comprises making composite fibers of side-by-side type or sheath/core type from a higher melting resin component and a lower melting resin component, followed by thermal bonding thereof, as disclosed formerly in Japanese Patent Publication Nos. 22547/1969 and 12380/1977, which process has become the basic technique for producing nonwoven fabric products which are used as constituent materials for disposable type diapers, sanitary napkins and the like which have been rapidly growing in the market in recent years. In such process, as the lower melting resin component, high density polyethylene, conventional branched type low density polyethylene, ethylene-vinyl acetate copolymer, atactic polypropylene, polybutene, etc. have been used, while as the higher melting resin component, isotactic polypropylene, polyester, polyamide, etc. have been used.

However, with abrupt growth of nonwoven fabric products in the market, it has become a great demand to have a product which is excellent in spinnability and capable of producing filaments of small denier stably and continuously in carrying out spinning and capable of effecting uniform thermal bonding at a lower temperature and within a shorter time in heat treatment for forming a nonwoven fabric, and is also endowed with both high nonwoven fabric tenacity and soft hand when formed into a nonwoven fabric. For exhibiting soft hand, the spun filament is required to be of small denier. In this regard, soft resins having a long chain branching such as conventional branched type low density polyethylene and ethylene-vinyl acetate copolymer which are to be used as lower melting components, have generally high elongational viscosity and therefore are susceptible to scission during spinning, whereby drawing ratio cannot be increased. Thus fibers of small denier can be prepared with difficulty. Accordingly, high density polyethylene entailing fewer such problems with relatively good fiber forming property has been employed primarily as the lower melting component, and compositely spun together with polypropylene or the like etc. As the high melting component into fibers of side-by-side type or sheath/core type. However, high density polyethylene is insufficient in fusion bonding characteristic for the level now demanded and inferior in productivity due to high temperature and long time required for heat treatment. Besides, for exhibiting soft hand, it is preferable to use fibers of the smallest possible fineness and make specific volume higher in nonwoven fabric formation to make the unit weight lower, and hence there is a tendency that the effectively bonded area or cross-over point number of the fiber cross-over points responsible for the strength of nonwoven fabric is reduced. Recently, an ethylene-α-olefin copolymer represented by linear low density polyethylene which has approximately comparable spinnability as compared with high density polyethylene, is attracting attention as the resin meltable at lower temperature, but no sufficiently satisfactory resin responding to the above demands can be found yet.

On the other hand, spinning of thermally bondable composite fibers is ordinarily practiced at a temperature higher than the melting point of the higher melting component as a matter of course, and practically at a considerably high temperature of 250° C. to 350° C., because the melt viscosities of the respective components are required to be adequately controlled for forming sheath/core forms at the fiber sections. Therefore, in case of ethylene-α-olefin copolymers which have more short chain branchings, with greater extrusion resistance and larger tendency to generate heat by shearing as compared with high density polyethylene, the molecular structure change by crosslinking deterioration during spinning may become a very serious problem. This can be estimated, for example, from a great change in melt flow ratio before and after spinning. Such molecular structure change has detrimental effect on fusion bonding characteristic through formation of oxidized skin on the fiber surface, in addition to causing lowering of continuous running performance by fluctuation of the filaments during spinning due to thermal decomposition or by frequent occurrence of cutting troubles of filaments due to gel generation caused by molecular crosslinking. As a countermeasure against these troubles, since the conditions such as spinning temperature, etc. can be changed with difficulty, sufficient preventive recipe against oxidation deterioration must be applied on the resin, and also in this respect, said material has not yet been sufficiently investigated.

As stated above, though it has been expected that some of ethylene-α-olefin copolymers would have more suitable characteristics as the lower melting resin component of thermally bondable composite fibers than high density polyethylene, there has been obtained no product yet which is sufficiently satisfactory as the thermally bonded nonwoven fabric endowed with both high nonwoven fabric tenacity and soft hand.

SUMMARY OF THE INVENTION

An object of the present invention is to obtain fibers for nonwoven fabric free from these drawbacks of the prior art, namely without filament scission even at high ratio spinning draft, with good hand as well as good fusion bonding characteristics, and to obtain a thermally bonded nonwoven fabric endowed with both high nonwoven fabric tenacity and soft hand by the use thereof.

The present inventors have studied intensively in order to solve the above problems, and consequently found that an ethylene-α-olefin copolymer having a relatively narrower molecular weight distribution, specific melt flow rate and density obtained by copolymerization of ethylene and a higher α-olefin of butene-1 or higher is excellent in spinnability and stretchability and has greatly improved fusion bonding characteristics, and further that the thermally bonded nonwoven fabric obtained therefrom can have soft hand as well as dramatically improved nonwoven fabric tenacity by restricting the above mentioned molecular structure change during high-temperature spinning within the extent without any problem by blending specific amounts of a phenol type antioxidant and a sulfur type antioxidant in combination thereby to elongate markedly the oxidation induction time of the material, thus accomplishing the present invention.

More specifically, the present invention provides a thermally bonded nonwoven fabric with a unit weight of 10 to 40 g/m$^2$, comprising 20 to 100% by weight of composite fibers with a fineness of 0.5 to 8 denier and 80 to 0% by weight of other fibers as the constituent fibers, the composite fiber comprising a first component which is an ethylene-α-olefin copolymer composition comprising an ethylene-α-olefin copolymer containing 0.5 to 4% by weight of an α-olefin having 4 to 12 carbon atoms blended with 0.01 to 0.3% by weight of a phenol type antioxidant and 0.01 to 0.3% by weight of a sulfur type antioxidant, having a Q-value (weight average molecular weight/number average molecular weight) of 4 or less, a density of 0.930 to 0.950 g/cm$^3$, a melt flow rate of 5 to 50 g/10 min. and an oxidation induction time at 210° C. of 10 min. or longer, and a second component which is a thermoplastic resin having a melting point higher by at least 20° C. than that of the first component, with a constitutional ratio (sectional area ratio) of the first component to the second component being 35:65 to 70:30, said first component of the composite fiber forming at least a proportion of the fiber surface continuously along the length of each fiber and adhering through melting mutually the constituent fibers.

The above ethylene-α-olefin copolymer to be used as the lower melting resin component of the composite fibers for thermally bonded nonwoven fabric according to the present invention is generally polymerized by the use of an ionic polymerization catalyst. For obtaining a copolymer having a Q-value necessary for the lower melting resin component, it is preferable to use a Zieglar catalyst, a Kaminsky type catalyst as the catalyst. As the polymerization method, any of the gas phase method, the solution method, the slurry method and the high pressure ionic polymerization method conducted at a pressure of 200 kg/cm$^2$ or higher and a temperature of 150° C. or higher may be applicable.

The α-olefin to be used as the comonomer is a 1-olefin having 4 to 12 carbon atoms including, for example, butene-1, pentene-1, hexene-1, 4-methylpentene-1, heptene-1, octene-1, nonene-1, decene-1 and the like, preferably butene-1, hexene-1, 4-methylpentene-1 and octene-1. In this case, the α-olefin is not limited to one kind, but a multi-component copolymer by use of two or more kinds may also be used.

When propylene is used as the α-olefin, it is difficult to obtain the desired Q-value by polymerization according to the slurry method and even if the Q-value is satisfied the fiber quality will be inferior.

The α-olefin content in the ethylene-α-olefin copolymer obtained is 0.5 to 4% by weight, particularly preferably 1.5 to 4% by weight for 1-olefin having 4 carbon atoms, 0.7 to 3.5% by weight for 1-olefin having 5 to 7 carbon atoms, and 0.5 to 3% by weight for 1-olefin having 8 to 12 carbon atoms. Outside this range, fusion bonding characteristics and soft hand cannot be satisfied.

The density of the ethylene-α-olefin copolymer is measured by the density gradient column method according to JIS K6760, and is within the range of 0.930 to 0.950 g/cm$^3$. If the density exceeds 0.950, fusion bondability at lower temperature within a shorter time is inferior, while with a density less than 0.930, specific volume on fusion tends to be lowered to give a paper-like nonwoven fabric, whereby soft hand tends to be exhibited with difficulty, and also the tensile strength at the bonded cross-over point is undesirably lowered. Particularly preferable density is from 0.940 to 0.948 g/cm$^3$.

The Q-value of the copolymer, which is an important requirement for the present invention, is a ratio of weight average molecular weight to number average molecular weight measured by gel permeation chromatography in o-dichlorobenzene solution at 140° C.

The ethylene-α-olefin copolymer having the Q-value of 4 or less is used in the present invention with respect to spinnability, stretchability, fusion bonding characteristics, and storage stability. The lower limit of the Q-value is 2 under the currently used catalyst system and production process, however, it is presumed that it may be possibly made smaller than 2, in view of the tendency of the effect. If the Q-value of said copolymer exceeds 4, it is not preferable because its spinnability and stretchability are lowered.

Further, it has been clarified by the present inventors that the Q-value is related to fusion bonding characteristics. That is, for producing a nonwoven fabric from the composite fibers of the present invention, shear viscosity at the bonding interface during heating by a heating roll or a heating oven should be preferably lower, and the shear viscosity becomes higher if the Q-value exceeds 4, whereby higher temperature or longer time is required for thermal bonding. Further, if the Q-value is greater than 4, the polymer components of a high molecular weight are contained in a large amount and therefore gellation is liable to occur due to molecular crosslinking caused during prolonged running under the general production conditions wherein extrusion is conducted at 210° C. or higher, whereby spinnability and fusion bonding characteristics will be lowered. Large Q-value also means inclusion of a large amount of polymer components of a low molecular weight, and thus the copolymer is subject to oxidation deterioration under the severe heat condition during extruding to readily form oxidized skin on the surface, which could be a cause of lowering of fiber quality with years. Accordingly, as a countermeasure against this problem, antioxidants in an excessive amount must be added, leading to a fear of bleeding or discoloration and an economical disadvantage.

The melt flow rate of the ethylene-α-olefin copolymer is 5 to 50 g/10 min., preferably 5 to 30 g/10 min. If the melt flow rate is less than the above range, extrusion temperature becomes higher to readily cause molecular crosslinking, while if the melt flow rate exceeds the above range, spinnability of the composite fiber will be abruptly lowered.

In the ethylene-α-olefin copolymer, the short chain branchings introduced by the α-olefin are not intramolecularly and intermolecularly homogeneous. Distribution of such short chain branching affects fusion bonding characteristics of the fiber. This distribution may be grasped as, for example, the contents of the high molecular weight component and the low crystalline component contained therein. As regards fusion bonding characteristics, low crystallinity is preferable for wettability and melting liquefaction, and high molecular weight is preferable with respect to the crossing point tensile strength after solidification by cooling. Thus, the presence of a high molecular weight component with low crystallinity is important. However, if the amount of short chain branching in the high molecular weight component is merely increased by enhancing the copolymerization ratio of the α-olefin, the amount of low crystalline low molecular weight component is also greatly increased, whereby the tensile strength at cross-over point will be contrariwise lowered.

Thus, a proper amount of the low crystalline high molecular weight component is required. The amount of such component can be grasped as the amount of the high molecular weight component of a molecular weight of $5\times10^4$ or more and the content therein of low crystalline component eluted between 40° C. and 85° C., which are determined by carrying out a fractionation capable of both crystallinity fractination and molecular weight fractionation with o-dichlorobenzene as the solvent by the use of a gel permeation chromatography system for molecular weight fractionation to which a temperature variable column for crystallinity fractionation is connected. This measurement method is disclosed in J. Appl. Polymer Sci., vol. 26, pp. 4217–4231 (1981). Preferable amounts are 8 to 25% by weight for the high molecular weight component of $5\times10^4$ or more, and 10 to 35% by weight for the low crystalline component content in that component.

In the present invention, it is necessary to elongate to some extent the oxidation induction time, which is generally deemed to be a measure of oxidative deterioration resistance, in view of the above various problems during spinning due to the molecular structural change of the resin and for preserving lowering of fusion bonding characteristics due to surface oxidation of the fibers at the level practically without problem. It has been found that, when the oxidation induction time as determined by the method as described below is elongated to 10 minutes or longer, decrease in melt flow rate of the resin after spinning to that before spinning is suppressed within 10% and hence no substantial change is occurred in the molecular weight distribution. Provided that the Q-value of the ethylene-α-olefin copolymer to be used in the present invention is suitable, elongation to the above mentioned degree of the oxidation induction time can be sufficiently achieved by use of a small amount of combined antioxidants, namely by the use in combination of 0.01 to 0.3% by weight of a phenol type antioxidant and 0.01 to 0.3% by weight of a sulfur type antioxidant. Further, the elongation of oxidation induction time according to the present invention is accompanied by additional advantage that coloration and odor due to deterioration can be successfully overcome.

Such phenol type antioxidants may include 1,1,3-tris(2-methyl-4-hydroxy-5-t-butylphenyl)butane, tetrakis[methylene-3-(3,5-di-t-butyl-4-hydroxy)propionate]methane, 4,4'-thiobis(6-t-butyl-m-cresol), 1,3,5-trimethyl-2,4,6-tris(3,5-di-t-butyl-4-hydroxybenzyl)benzene, n-octadecyl-β-(4'-hydroxy-3',5'-di-t-butylphenyl)-propionate, tris(3,5-di-t-butyl-4-hydroxybenzyl-)isocyanurate, 4,4'-butylidene-bis(6-t-butyl-m-cresol), 1,3,5-tris(4-t-butyl-3-hydroxy-2,6-dimethylbenzyl-)isocyanuric acid, triester of 3,5-di-t-butyl-4-hydroxycyanuric acid and 1,3,5-tris(2-hydroxyethyl)-s-triazine-2,4,6-(1H, 3H, 5H)trione, bis[3,3-bis(4'-hydroxy-3'-t-butylphenyl)butyric acid]glycol ester, triethylene glycol-bis-3-(3-t-butyl-4-hydroxy-5-methylphenyl)propionate, 2,6-di-t-butyl-4-ethylphenol, butylated hydroxyanisole, distearyl(4-hydroxy-3-methyl-5-t-butyl)benzylmalonate, propyl gallate, octyl gallate, dodecyl gallate, tocophenol, 2,2'-methylenebis(4-methyl-6-t-butylphenol), 2,2'-methylenebis(4-ethyl-6-t-butylphenol), 4,4'-butylidenebis(6-t-butyl-m-cresol), 2,4-(n-octylthio)-6-(4-hydroxy-3,5-di-t-butylanilino)-1,3,5-triazine, triethylene glycol-bis[3-(3,5-di-t-butyl-4-hydroxyphenyl)propionate], 2,2-thio-diethylenebis[3-(3,5-di-t-butyl-4-hydroxyphenyl)propionate], 2,2-thiobis(4-methyl-6-t-butylphenol), N,N'-hexamethylenebis(3,5-di-t-butyl-4-hydroxy-hydrocinnamide), 3,5-di-t-butyl-4-hydroxybenzylphosphonate-diethyl ester, bis[2-methyl-4-{3-n-alkyl(C12 or C14)thiopropionyloxy}-5-t-butylphenyl]-sulfide, 3,9-bis[1,1-dimethyl-2-{β-(3-t-butyl-4-hydroxy-5-methylphenyl)propionyloxy}ethyl]2,4,8,10-tetraoxaspiro[5,5]undecane, 2,2'-ethylidenebis(4,6-t-butylphenol), 2-t-butyl-2-hydroxy-5-methylbenzyl)-4-methylphenylacrylate, bis[3,3-bis(4'-hydroxy-3'-t-butylphenyl)butyric acid]glycol ester, 3,5-diphenyl-4-hydroxy-stearyl ester.

Particularly preferred are tetrakis[methylene-3-(3,5-di-t-butyl-4-hydroxyl)propionate]methane, n-octadecyl-β-[4'-hydroxy-3',5'-di-t-butylphenyl]propionate, tris(3,5-di-t-butyl-4-hydroxybenzyl)isocyanurate, 1,3,5-tris(4-t-butyl-3-hydroxy-2,6-dimethylbenzyl)isocyanurate.

On the other hand, sulfur type antioxidants may include di-myristyl-3,3'-thio-di-propionate, di-tridecyl-3,3'-thio-di-propionate, di-stearyl-3,3'-thio-di-propionate, di-lauryl-3,3'-thio-di-propionate, laurylstearyl-3,3'-thio-di-propionate, 3,3'-thio-di-propionic acid, di-cetyl-thio-di-propionate, di-stearyl-3,3'-methyl-3,3'-thio-di-propionate, bis[2-methyl-4-(3-n-alkyl-thio-propionyloxy)-5-t-butylphenyl]sulfide, pentaerytrid-tetra(β-lauryl-thiopropionate) di-octadecylsulfide, 2-mercaptobenzimidazole, 2-mercapto-5-methylbenzimidazole.

Particularly preferred are di-myristyl-3,3'-thio-di-propionate, di-lauryl-3,3'-thio-di-propionate, di-stearyl-3,3'-thio-di-propionate, lauryl-stearyl-3,3'-thio-di-propionate, penta-erytrid-tetra(β-laurylthiopropionate).

The thermoplastic resin to be used for the higher melting resin component of the composite fiber in the present invention is a resin having a melting point higher by at least 20° C. than that of the above mentioned ethylene-α-olefin copolymer as the lower melting resin component. Specifically, there may be included, for example, propylene polymers such as isotactic polypropylene, propylene-ethylene block copolymer, propylene-ethylene random copolymer, polyamides such as 6-nylon, 6,6-nylon, 1,1-nylon, polyesters such as polyethyleneterephthalate, polytetramethyleneterephthalate, and 4-methylpentene-1 polymer, etc. In the case of propylene polymers, preferably used are those having melt flow rate of 5 to 500 g/10 min., and those having melt flow rate of 5 to 100 g/10 min. are particularly preferable when the composite fiber with the ethylene-α-olefin copolymer as the lower melting resin component is drawn with a drawing ratio of 4-fold or more, because drawing can be effected with the adhesiveness at the interface between the lower melting resin component and the higher melting resin component being maintained. The use of thermoplastic resin having lower melting point is not preferred since the strength of fiber that is a basic property of the fiber is lowered and shrinkage deformation after formation into nonwoven fabric will be undesirably greater. Specifically, it is preferred that the melting point of the higher melting resin component is 150° C. or higher.

Preparation of a composite fiber by the use of both such components may be practiced in a conventional manner using a conventional device for composite extrusion spinning. There may be mentioned a manner, for example, wherein two extruders are used and the lower melting resin component and the higher melting resin component are respectively melt-extruded, and both are led through gear pumps into a spinneret with composite spinning orifices of sheath/core type or side-by-side type and spun through this spinneret to form the composite fiber. In general, an unstretched composite fiber is drawn under heating to 2- to 5-times to form a final composite fiber of 0.5 to 8 denier. When the composite fiber obtained is of the sheath/core type, the core is not necessarily at the center in the cross-section, and therefore the thickness of the sheath may be nonuniform in places. The composite fiber constituting ratio of the lower melting resin component/the higher melting resin component is 35:65 to 70:30, preferably 40:60 to 70:30, in terms of sectional area ratio. This value has been determined with respect to spinnability, stretchability, fusion characteristics, and nonwoven fabric tenacity.

The fibrous assembly to be formed into a nonwoven fabric by heat treatment in the present invention is not limited to the heat-fusible composite fibers alone, and a mixture of said composite fibers with other fibers may also be used. In this case, from the standpoint of nonwoven fabric tenacity and hand, other fibers should preferably comprise less than 80% by weight of the mixture as a whole and have a fiber diameter of 10 denier or less. Specifically, for example, there may be included natural fibers such as cotton, etc., regenerated fibers such as viscose rayon, etc., synthetic fibers such as polyester fibers, polypropylene fibers, acrylic fibers, etc., and, a mixture of plural kinds of fibers may be used according to necessity. Preparation of the fibrous assembly from the composite fibers alone or a mixture with other fibers may be practiced any conventional method such as the air-laid method, the carding method and the wet-laid method. As a method for effecting thermal bonding of the above fibrous assembly at a temperature between the melting point of the lower melting resin component and the melting point of the higher melting resin component, there can be employed a method in which a suction drum type dryer, a suction band type dryer, a Yankee dryer or a conventional calender roll or embossing roll is used. The thermally bonded nonwoven fabric of the present invention, which is particularly required to have both nonwoven fabric tenacity and soft hand, must have a unit weight of 10 to 40 g/m$^2$.

In acordance with the present invention, a thermally bonded nonwoven fabric having soft hand as well as dramatically improved nonwoven fabric tenacity is obtained due to the use of a specific composite fiber of the sheath/core type or the side-by-side type which can inhibit the molecular structure change in high temperature spinning to the level without any problem, is excellent in spinnability, stretchability and also excellent in thermal fusion bonding characteristics when formed into nonwoven fabric, by using a specific ethylene-$\alpha$-olefin copolymer at the sheath portion and imparting thereto an oxidation induction time of a specific period or longer by blending a phenol type antioxidant and a sulfur type antioxidant with the copolymer.

In the following Examples, evaluations were made according to the methods as described below:

(1) Melt flow rate of ethylene-$\alpha$-olefin copolymer (MFR): JIS K6760;

(2) Melt flow rate of polypropylene or propyleneethylene random copolymer (MFR): ASTM D1238;

(3) Density: JIS K6760 (Density gradient column method);

(4) Q-value of weight average molecular weight measured by gel permeation chromatography at 140° C. in o-di-chlorobenzene solution divided by number average molecular weight;

(5) Melting point: 5 mg of a sample is sampled from a sheet with a thickness of 1 mm press molded at 160° C., set on a DSC device (produced by Perkin Elmer Co.), elevated in temperature to 160° C., maintained at that temperature for about 3 minutes, and then cooled down to 30° C. at a temperature dropping rate of 10° C./min. Then, of the melting peaks appearing when the temperature is elevated from this state to 160° C. at an elevation rate of 10° C./min., the peak temperature of the maximum peak is defined as the melting point;

(6) Oxidation induction time: in a platinum sample pan of a differential thermobalance produced by Rigaku Denki Co., 5 mg of a sample with a thickness of 0.5 mm of a press sheet is mounted, elevated in temperature in nitrogen atmosphere to 210° C. and then oxidized by passing oxygen to the sample at a flow rate of 50 ml/min. The time from the point at which nitrogen is changed over to oxygen to the point at which the temperature of the sample pan begins to be elevated by oxidation heat generation is defined as the oxidation induction time;

(7) High molecular weight component and low crystalline component therein: by use of a gel permeation chromatography system for molecular weight fractionation to which a temperature variable column for crystallinity fractionation is connected, cross fractionation capable of both crystallinity fractionation and molecular weight fractionation is performed with o-dichlorobenzene as the solvent to determine the proportions of the high molecular weight component with molecular weight of $5\times10^4$ or more and the low crystalline component therein eluted between 40° C. and 85° C.;

(8) Spinnability: a nozzle with a die length of 4.0 mm and a die diameter of 2.1 mm is set on a melt tension tester produced by Toyo Seiki Co. and 7 g of a sample is filled therein. After the temperature is set at 140° C., a piston rod is permitted to fall at a speed of 5 mm per minute to extrude the molten strand. The strand is taken-up by passing through rolls with a radius of 70 mm rotating in opposite directions. The rotational speed of the rolls is gradually elevated, and the take-up speed when the strand is cut is determined as a measure of spinnability;

(9) Hand of the nonwoven fabrics: organoleptic test is conducted by 5 members.

○: judged as soft by all the members,

Δ: judged as soft by 1 to 4 of the members,

×: judged as lacking softness by all the members;

(10) Nonwoven fabric tenacity: breaking tenacity (g) is measured, according to JIS L1085 (the testing method of nonwoven padding cloth), on a test strip of 50 mm width with a grip interval of 100 mm and a tensile speed of 300 mm/min. Using the value thus obtained, the nonwoven tenacity (km) is determined by the following formula:

$$\text{Nonwoven fabric tenacity} = \frac{\text{Breaking tenacity (g)}}{\text{Unit weight of nonwoven fabric (g/m}^2) \times \text{Sample width (mm)}};$$

(11) Specific volume: calculated from the unit weight of nonwoven fabric (g/m$^2$) and the thickness determined under a load of 10 g/cm$^2$; and

(12) Intrinsic viscosity: measured at 25° C. by use of a 1:1 solvent mixture of phenol and ethane tetrachloride.

EXAMPLES 1-6 AND COMPARATIVE EXAMPLES 1-6

By use of the respective ethylene-α-olefin copolymer compositions polymerized with a Ziegler catalyst as shown in Table 1 for the sheath component and the propylene type polymers as shown in the same Table for the core component, melt spinning was performed with a composite ratio of sheath/core of 50/50, through a sheath/core type composite spinning orifice with a diameter of 0.5 mm at an extrusion temperature of 260° C. for the sheath component, and 300° C. for the core component and an orifice temperature of 270° C. to obtain an unstretched fiber. At this time, feeding of the core component was temporarily stopped and only the sheath component was spun to obtain a sample for measurement of MFR after spinning.

After the unstretched fibers were drawn to form composite fibers of 2 denier and then given mechanical crimp, they were cut to a fiber length of 51 mm to obtain staple composite fibers. The characteristics of the composite fibers are shown in the same Table. Next, the composite fibers were passed through a carding machine to form fibrous webs, and the fibrous webs were subjected to heat treatment by a suction band type dryer at a temperature in the range of 125° C. to 145° C. as shown in Table 2 for 30 seconds to obtain nonwoven fabrics shown in Table 2. The properties of the nonwoven fabrics are shown in the same Table. It is apparent from comparison of Examples with Comp. Examples that Q-value should be preferably smaller and those of Examples are excellent in spinnability and thermal fusion bonding characteristics and have soft hand as thermally bonded nonwoven fabrics and dramatically improved nonwoven fabric tenacity. More particularly, nonwoven fabrics shown in Examples not only exhibit high nonwoven fabric tenacity after heat treatment at 135° C. or higher, but also exhibit high nonwoven fabric tenacity even after heat treatment at lower temperature than that range, namely at 130° C. Besides, it can be appreciated that nonwoven fabrics with soft hand can be obtained over such heat treatment temperature region.

TABLE 1

| | Fiber preparation examples | | | | | Fiber preparation comparative examples | | | | | |
|---|---|---|---|---|---|---|---|---|---|---|---|
| | 1 | 2 | 3 | 4 | 5 | 1 | 2 | 3 | 4 | 5 | 6 |
| Antioxidant (wt. %) | | | | | | | | | | | |
| AO-1 | — | 0.1 | — | — | — | — | — | — | — | — | — |
| AO-2 | 0.05 | — | 0.05 | 0.05 | 0.05 | 0.05 | 0.05 | 0.05 | — | 0.05 | 0.05 |
| AO-3 | — | — | — | — | — | — | — | — | 0.03 | — | — |
| AO-4 | 0.05 | 0.05 | 0.05 | 0.05 | 0.05 | 0.05 | 0.05 | 0.05 | — | 0.05 | 0.05 |
| Sheath component | | | | | | | | | | | |
| MFR (g/10 min.) | 15.0 | → | 6.0 | 20 | 15.0 | 15 | 20 | → | 15 | → | → |
| Density (g/cm$^3$) | 0.945 | → | 0.942 | 0.945 | → | → | 0.960 | 0.926 | 0.945 | → | → |
| Q-value (—) | 3.3 | → | 3.5 | → | 3.3 | 5.5 | 4.2 | 3.6 | 3.3 | → | → |
| α-olefin | butene-1 | → | → | → | → | propylene | butene-1 | → | → | → | → |
| content (wt. %) | 2.5 | → | 2.7 | 2.6 | 2.5 | 3.6 | 0.6 | 7.7 | 2.5 | → | → |
| m.p. (°C.) | 128 | → | 127 | 129 | 128 | 129 | 131 | 125 | 128 | → | → |
| Spinnability (m/min.) | >500 | → | 410 | >500 | → | 360 | 440 | >500 | → | → | → |
| High molecular weight component (wt. %) | 16.5 | → | 22.8 | 14.4 | 16.5 | 27.1 | 18.9 | 12.2 | 16.5 | → | → |
| Low crystalline component (wt. %) | 14.6 | → | 23.3 | 18.0 | 14.6 | 19.4 | 0 | 40.6 | 14.6 | → | → |
| Oxidation induction time (min.) | 45 | 33 | 43 | 44 | 45 | 44 | 45 | → | 2.5 | 45 | → |
| MFR after spinning (g/10 min.) | 14.4 | 13.8 | 5.9 | 19.0 | 14.5 | 14.1 | 19.4 | 18.6 | 12.8 | 14.4 | 14.3 |
| Core component | | | | | | | | | | | |
| Thermoplastic resin | PP | → | → | → | → | → | → | → | → | EPP | PP |
| MFR (g/10 min.) | 20 | → | → | → | → | → | → | → | → | 10 | 20 |
| m.p. (°C.) | 16.5 | → | → | → | → | → | → | → | → | 145.6 | 165 |
| Composite fiber | | | | | | | | | | | |
| Take-up speed (m/min.) | 640 | → | 600 | 640 | → | 600 | 640 | → | → | → | → |
| Drawing ratio (times) | 4.0 | 4.0 | 4.4 | 4.0 | 4.0 | 4.4 | 4.0 | 4.0 | 4.0 | 4.0 | 4.0 |
| Sheath/core composite ratio | 50/50 | → | → | → | 35/65 | 50/50 | → | → | → | → | 30/70 |
| Fineness (d) | 2.0 | → | → | → | → | → | → | → | → | → | → |

(Note):

AO-1: tetrakis[methylene-3-(3,5-di-t-butyl-4-hydroxyl)propionate]methane

AO-2: 1,3,5-tris-(4-t-butyl-3-hydroxy-2,6-dimethylbenzyl)isocyanurate

AO-3: n-octadecyl-β-(4'-hydroxy-3',5'-di-butylphenyl)propionate

AO-4: di-myristyl-3,3'-thio-di-propionate

PP: polypropylene

EPP: propylene-ethylene random copolymer with ethylene content of 4.8 wt. %

TABLE 2

| | Example and Comparative example No. | | | | | | | | | | | |
|---|---|---|---|---|---|---|---|---|---|---|---|---|
| | Examples | | | | | | Comparative Examples | | | | | |
| Composite fiber (corresponding No. in Table 1) | 1 ex. 1 | 2 ex. 2 | 3 ex. 3 | 4 ex. 4 | 5 ex. 1 | 6 ex. 5 | 1 comp. ex. 1 | 2 comp. ex. 2 | 3 comp. ex. 3 | 4 comp. ex. 4 | 5 comp. ex. 5 | 6 comp. ex.6 |
| Others fibers | | | | | | | | | | | | |
| Mixing ratio (wt. %) | 0 | → | → | → | PP fiber 50 | 0 | 0 | → | → | → | → | → |
| Fineness (d) | — | — | — | — | 2.0 | — | — | — | — | — | — | — |
| Fiber length (mm) | — | — | — | — | 51 | — | — | — | — | — | — | — |
| Non Woven fabric | | | | | | | | | | | | |
| Unit weight (g/m$^2$) | 28 | 31 | 30 | 27 | 29 | 31 | 29 | 30 | 27 | 28 | 29 | 30 |
| Specific volume (cm$^3$/g) | 52 | 51 | 56 | 48 | 72 | 55 | 64 | 53 | 38 | 49 | 34 | 56 |
| Non Woven fabric tenacity (km) (lateral direction) | | | | | | | | | | | | |
| Heat treatment temp. (°C.) | | | | | | | | | | | | |
| 125 | 0.05 | 0.04 | 0.08 | 0.04 | 0.02 | 0.03 | 0.03 | 0 | 0.10 | 0.04 | 0.01 | 0.03 |
| 130 | 0.87 | 0.84 | 0.91 | 0.84 | 0.43 | 0.76 | 0.41 | 0.48 | 0.61 | 0.56 | 0.45 | 0.68 |
| 135 | 1.05 | 1.02 | 1.07 | 0.98 | 0.53 | 0.88 | 0.65 | 0.75 | 0.69 | 0.78 | 0.68 | 0.76 |
| 140 | 1.09 | 1.04 | 1.18 | 1.00 | 0.54 | 0.89 | 0.82 | 0.88 | 0.71 | 0.80 | 0.74 | 0.77 |
| Hand | | | | | | | | | | | | |
| Heat treatment temp. (°C.) | | | | | | | | | | | | |
| 145 | 1.13 | 1.10 | 1.24 | 1.02 | 0.57 | 0.91 | 0.86 | 0.89 | 0.74 | 0.81 | 0.72 | 0.79 |
| 125 | ○ | ○ | ○ | ○ | ○ | ○ | ○ | ○ | ○ | ○ | ○ | ○ |
| 130 | ○ | ○ | ○ | ○ | ○ | ○ | ○ | ○ | ○ | ○ | ○ | ○ |
| 135 | ○ | ○ | ○ | ○ | ○ | ○ | ○ | ○ | Δ | ○ | ○ | ○ |
| 140 | ○ | ○ | ○ | ○ | ○ | ○ | ○ | Δ | x | Δ | x | ○ |
| 145 | Δ | Δ | ○ | Δ | ○ | ○ | Δ | Δ | x | x | x | ○ |

EXAMPLES 7–8 AND COMPARATIVE EXAMPLES 7–8

By use of the respective ethylene-α-olefin copolyemr compositions shown in Table 3 (obtained by polymerization with a Ziegler catalyst) for the sheath component and the polyethyleneterephthalate shown in the same Table for the core component, sheath/core type composite unstretched fibers were obtained by performing melt spinning through a sheath/core type composite spinning orifice with a diameter of 0.5 mm at an extrusion temperature for the sheath component of 270° C., an extrusion temperature for the core component of 295° C. and an orifice temperature of 285° C.

The unstretched fibers were drawn at 80° C. at drawing ratios shown in Table 3 and given mechanical crimp and then cut to a fiber length of 51 mm to obtain staple composite fibers. The characteristics of the composite fibers are shown in the same Table.

Next, after the composite fibers were formed into fibrous webs by passing through a carding machine, they were subjected to heat treatment at a temperature in the range of 125° C. to 145° C. as shown in Table 4 for 30 seconds, by passing through a suction band type dryer to obtain nonwoven fabrics shown in Table 4. The properties of the nonwoven fabrics are shown in the same Table.

As is apparent from the Table, the nonwoven fabrics shown in Examples were greater nonwoven fabric tenacity, and softer hand as compared with those shown in Comparative Examples.

TABLE 3

| | Fiber preparation examples | | Fiber preparation Comparative examples | |
|---|---|---|---|---|
| | 6 | 7 | 7 | 8 |
| Antioxidant (wt. %) | | | | |
| AO-2 | 0.05 | 0.05 | 0.05 | — |
| AO-3 | — | — | — | 0.03 |
| AO-4 | 0.05 | 0.05 | 0.05 | — |
| Sheath component | | | | |
| MFR (g/10 min.) | 15 | 20 | 20 | 15 |
| Density (g/cm$^3$) | 0.945 | 0.945 | 0.945 | 0.945 |
| Q-value (—) | 3.3 | 3.5 | 3.6 | 3.3 |
| α-olefin | butene-1 | butene-1 | butene-1 | butene-1 |
| content (wt. %) | 2.5 | 2.6 | 7.7 | 2.5 |
| m.p. (°C.) | 128 | 129 | 125 | 128 |
| Spinnability (m/min.) | >500 | >500 | >500 | >500 |
| High molecular weight component (wt. %) | 16.5 | 14.4 | 12.2 | 16.5 |
| Low crystalline component (wt. %) | 14.6 | 18.0 | 40.6 | 14.6 |
| Oxidation induction time (min.) | 45 | 44 | 45 | 2.5 |
| MFR after spinning (g/10 min.) | 14.2 | 18.8 | 18.6 | 12.2 |
| Core component | | | | |
| Thermoplastic resin | PET | PET | PET | PET |

TABLE 3-continued

| | Fiber preparation examples | | Fiber preparation Comparative examples | |
|---|---|---|---|---|
| | 6 | 7 | 7 | 8 |
| Intrinsic viscosity | 0.68 | 0.68 | 0.68 | 0.68 |
| m.p. (°C.) | 260 | 260 | 260 | 260 |
| Composite fiber | | | | |
| Take-up speed (m/min.) | 860 | 860 | 860 | 860 |
| Drawing ratio (times) | 3.7 | 3.7 | 3.7 | 3.7 |
| Shealth/core composite ratio | 50/50 | 50/50 | 50/50 | 50/50 |
| Fineness (d) | 2.0 | 2.0 | 2.0 | 2.0 |

(Note)
AO-2: 1,3,5-tris-(4-t-butyl-3-hydroxy-2,6-dimethylbenzyl)isocyanurate
AO-3: n-octadecyl-β-(4'-hydroxy-3',5'-di-t-butylphenyl)propionate
AO-4: di-myristyl-3,3'-thio-di-propionate
PET: Polyethyleneterephthalate

TABLE 4

| Example and Comparative example No. | | | | Examples 7 | Examples 8 | Comparative Examples 7 | Comparative Examples 8 |
|---|---|---|---|---|---|---|---|
| Composite fiber (corresponding No. in Table 3) | | | | ex. 6 | ex. 7 | comp. ex. 7 | comp. ex. 8 |
| Other fiber | Mixing ratio (wt. %) | | | 0 | → | 0 | → |
| | Fineness (d) | | | — | — | — | — |
| Non Woven fabric | Fiber length (mm) | | | — | — | — | — |
| | Unit weight (g/m²) | | | 31 | 30 | 29 | 31 |
| | Specific volume (cm³/g) | | | 75 | 72 | 70 | 71 |
| | Nonwoven fabric tenacity (km) (lateral direction) | Heat treatment temp. (°C.) | 125 | 0.03 | 0.03 | 0.04 | 0.02 |
| | | | 130 | 0.52 | 0.40 | 026 | 0.35 |
| | | | 135 | 0.63 | 0.51 | 0.32 | 0.41 |
| | | | 140 | 0.66 | 0.57 | 0.38 | 0.44 |
| | | | 145 | 0.68 | 0.58 | 0.39 | 0.47 |
| | Hand | Heat treatment temp. (°C.) | 125 | ○ | ○ | ○ | ○ |
| | | | 130 | ○ | ○ | ○ | ○ |
| | | | 135 | ○ | ○ | ○ | ○ |
| | | | 140 | ○ | ○ | Δ | ○ |
| | | | 145 | ○ | ○ | Δ | Δ |

EXAMPLES 9-10 AND COMPARATIVE EXAMPLES 9-10

By use of the respective ethylene-α-olefin copolymer compositions shown in Table 5 (obtained by polymerization with a Ziegler catalyst) for the first component and the polypropylene shown in the same Table for the second component, side-by-side type composite unstretched fibers were obtained by performing melt spinning through a side-by-side type composite spinning orifice with a diameter of 0.5 mm at an extrusion temperature for the first component of 260° C., an extrusion temperature for the core component of 300° C. and an orifice temperature of 270° C.

The unstretched fibers were drawn at 90° C. at drawing ratios shown in Table 5 and given mechanical crimp and then cut to a fiber length of 51 mm to obtain staple composite fibers. The characteristics of the composite fibers are shown in the same Table.

Next, after the composite fibers were formed into fibrous webs by passing through a carding machine, they were subjected to heat treatment in the same manner as the preceding examples to obtain nonwoven fabrics shown in Table 6. The properties of the nonwoven fabrics are shown in the same Table.

As is apparent from the Table, the nonwoven fabrics shown in Examples were greater nonwoven fabric tenacity, and softer hand as compared with those shown in Comparative Examples.

TABLE 5

| | Fiber preparation examples | | Fiber preparation 31/45 comparative examples | |
|---|---|---|---|---|
| | 8 | 9 | 9 | 10 |
| Antioxidant (wt. %) | | | | |
| AO-2 | 0.05 | 0.05 | 0.05 | — |
| AO-3 | — | — | — | 0.03 |
| AO-4 | 0.05 | 0.05 | 0.05 | — |
| First component | | | | |
| MFR (g/10 min.) | 15.0 | 6.0 | 20 | 15 |
| Density (g/cm³) | 0.945 | 0.942 | 0.926 | 0.945 |
| Q-value (—) | 3.3 | 3.5 | 3.6 | 3.3 |
| α-olefin | butene-1 | → | butene-1 | → |
| content (wt. %) | 2.5 | 2.7 | 7.7 | 2.5 |
| m.p. (°C.) | 128 | 127 | 125 | 128 |
| Spinnability (m/min.) | >500 | 410 | >500 | >500 |
| High molecular weight | 16.5 | 22.8 | 12.2 | 16.5 |

TABLE 5-continued

| | Fiber preparation examples | | Fiber preparation 31/45 comparative examples | |
|---|---|---|---|---|
| | 8 | 9 | 9 | 10 |
| component (wt. %) | | | | |
| Low crystalline component (wt. %) | 14.6 | 23.3 | 40.6 | 14.6 |
| Oxidation induction time (min.) | 45 | 43 | 45 | 2.5 |
| MFR after spinning (g/10 min.) | 14.4 | 5.9 | 18.8 | 12.9 |
| Second component | | | | |
| Thermoplastic resin | PP | → | PP | → |
| MFR (g/10 min.) | 20 | → | 20 | → |
| m.p. (°C.) | 165 | → | 165 | → |
| Composite fiber | | | | |
| Take-up speed (m/min.) | 640 | 600 | 640 | 640 |
| Drawing ratio (times) | 4.0 | 4.4 | 4.0 | 4.0 |
| First component/second component composite ratio | 50/50 | → | 50/50 | → |
| Fineness (d) | 2.0 | → | 2.0 | → |

(Note)
AO-2: 1,3,5-tris-(4-t-butyl-3-hydroxy-2,6-dimethylbenzyl)isocyanurate
AO-3: n-octadecyl-β-(4'-hydroxy-3',5'-di-t-butylphenyl)propionate
AO-4: di-myristyl-3,3'-thio-di-propionate
PP: polypropylene

TABLE 6

| Example and Comparative example No. | | | | Examples 9 | Examples 10 | Comparative Examples 9 | Comparative Examples 10 |
|---|---|---|---|---|---|---|---|
| Composite fiber (corresponding No. in Table 5) | | | | ex. 8 | ex.9 | comp. ex. 9 | comp. ex. 10 |
| Other fibers | Mixing ratio (wt. %) | | | 0 | → | 0 | → |
| | Fineness (d) | | | — | — | — | — |
| | Fiber length (mm) | | | — | — | — | — |
| Nonwoven fabric | Unit weight (g/m²) | | | 32 | 30 | 29 | 30 |
| | Specific volume (cm³/g) | | | 61 | 66 | 44 | 59 |
| | Nonwoven fabric tenacity (km) (lateral direction) | Heat treatment temp. (°C.) | 125 | 0.04 | 0.03 | 0.08 | 0.02 |
| | | | 130 | 0.75 | 0.70 | 0.59 | 0.51 |
| | | | 135 | 0.91 | 0.89 | 0.68 | 0.65 |
| | | | 140 | 0.98 | 0.95 | 0.69 | 0.70 |
| | | | 145 | 1.05 | 0.99 | 0.72 | 0.71 |
| | Hand | Heat treatment temp. (°C.) | 125 | ○ | ○ | ○ | ○ |
| | | | 130 | ○ | ○ | ○ | ○ |
| | | | 135 | ○ | ○ | Δ | ○ |
| | | | 140 | ○ | ○ | Δ | ○ |
| | | | 145 | Δ | ○ | x | Δ |

What is claimed is:

1. A thermally bonded nonwoven fabric with a unit weight of 10 to 40 g/m², comprising 20 to 100% by weight of a composite fiber with a fineness of 0.5 to 8 denier and 80 to 0% by weight of other fibers as the constituent fibers, the composite fiber comprising a first component which is an ethylene-α-olefin copolymer composition comprising an ethylene-α-olefin copolymer containing 0.5 to 4% by weight of an α-olefin having 4 to 12 carbon atoms blended with 0.01 to 0.3% by weight of a phenol type antioxidant and 0.01 to 0.3% by weight of a sulfur type antioxidant, having a Q-value (weight average molecular weight/number average molecular weight) of 4 or less, a density of 0.930 to 0.950 g/cm³, a melt flow rate of 5 to 50 g/10 min. and an oxidation induction time at 210° C. of 10 min. or longer, and a second component which is a thermoplastic resin having a melting point higher by at least 20° C. than that of the first component, with a constitutional ratio (sectional area ratio) of the first component to the second component being 35:65 to 70:30, said first component of the composite fiber forming at least a proportion of the fiber surface continuously along the length of each fiber and adhering through melting mutually the constituent fibers.

2. The thermally bonded nonwoven fabric according to claim 1, wherein the ethylene-α-olefin has been polymerized using an ionic polymerization catalyst.

3. The thermally bonded nonwoven fabric according to claim 1, wherein the α-olefin having 4 to 12 carbon atoms is a member selected from the group consisting of butene-1, hexene-1, 4-methylpentene-1 and octene-1.

4. The thermally bonded nonwoven fabric according to claim 1, wherein the α-olefin content in the ethylene-α-olefin copolymer is 1.5 to 4% by weight for 1-olefin having 4 carbon atoms, 0.7 to 3.5% by weight for 1-olefin having 5 to 7 carbon atoms, and 0.5 to 3% by weight for 1-olefin having 8 to 12 carbon atoms.

5. The thermally bonded nonwoven fabric according to claim 1, wherein the density of the ethylene-α-olefin copolymer is 0.940 to 0.948 g/cm³.

6. The thermally bonded nonwoven fabric according to claim 1, wherein the melt flow rate of the ethylene-α-olefin copolymer is 5 to 30 g/10 min.

7. The thermally bonded nonwoven fabric according to claim 1, wherein the ethylene-α-olefin copolymer contains 8 to 25% by weight of a high molecular weight component of $5\times10^4$ or more, which high molecular weight component contains 10 to 35% by weight of a low crystalline component.

8. The thermally bonded nonwoven fabric according to claim 1, wherein the phenol type antioxidant is a compound selected from the group consisting of tetrakis[methylene-(3,5-di-t-butyl-4-hydroxyl)propionate]methane, tris(3,5-di-t-butyl-4-hydroxybenzyl-)isocyanurate, 1,3,5-tris(4-t-butyl-3-hydroxy-2,6-dimethylbenzyl)isocyanurate.

9. The thermally bonded nonwoven fabric according to claim 1, wherein the sulfur type antioxidant is a compound selected from the group consisting of dimyristyl-3,3'-tho-di-propionate, di-lauryl-3,3'-thio-di-propionate, di-stearyl-3,3'-thio-di-propionate, lauryl-stearyl-3,3'-thio-di-propionate, penta-erytrid-tetra(β-lauryl-thio-propionate).

10. The thermally bonded nonwoven fabric according to claim 1, wherein the thermoplastic resin used as the second component of the composite fiber is a resin selected from the group consisting of a propylene polymer, polyamide and polyester.

11. The thermally bonded nonwoven fabric according to claim 10, wherein the propylene polymer is an isotactic polypropylene, propylene-ethylene block copolymer or propylene-ethylene random copolymer, the polyamide is 6-nylon, 66-nylon or 11-nylon, and the polyester is polyethyleneterephthalate or polytetramethyleneterephthalate.

12. The thermally bonded nonwoven fabric according to claim 10, wherein the thermoplastic resin is a propylene polymer having melt flow rate of 5 to 500 g/10 min.

13. The thermally bonded nonwoven fabric according to claim 1, wherein the thermoplastic resin has a melting point of 150° C. or higher.

14. The thermally bonded nonwoven fabric according to claim 1, wherein said other fibers have fineness of 10 denier or lower.

15. The thermally fused nonwoven fabric according to claim 1, wherein said other fibers are selected from the group consisting of cotton fibers, viscose rayon fibers, polyester fibers, polypropylene fibers, acrylic fibers and the mixtures thereof.

* * * * *

UNITED STATES PATENT AND TRADEMARK OFFICE

CERTIFICATE OF CORRECTION

PATENT NO. : 4,770,925

DATED : September 13, 1988

INVENTOR(S) : Akihiko Uchikawa, et. al.

It is certified that error appears in the above-identified patent and that said Letters Patent is hereby corrected as shown below:

Column 5, line 50, change "(3,5-di-t-butyl-4-hydroxy)" to --(3',5'-di-t-butyl-4'-hydroxyphenyl)--;

line 57, change "isocyanuric acid" to --isocyanurate--;

lines 57 to 58, change "butyl-4-hydroxycyanuric" to --butyl-4-hydroxyhydrocinnamic--;

lines 60 to 62, change "glycol-bis-3-(3-t-butyl-4-hydroxy-5-methylphenyl)propionate," to --glycol-bis[3-(3-t-butyl-4-hydroxy-5-methylphenyl)propionate],--;

line 67, delete "4,4'-butylidenebis(6-t-butyl-m-cresol),"; and line 67, change "2,4-(n-octylthio)-" to --2,4-bis (n-octylthio) --.

Column 5, line 68, delete "trieth-".

Column 6, line 1, change "ylene glycol" to --1,6-hexanediol--;

line 5 to 6, change "hydroxybenzylphosphonate" to --hydroxybenzylphosphate--;

line 7, change "or" to --~ --.

lines 11 to 12, change "2-t-butyl-2-hydroxy-5-methylbenzyl)" to --2-t-butyl-6-(3'-t-butyl-5-methyl-2'-hydroxybenzyl) --;

UNITED STATES PATENT AND TRADEMARK OFFICE

CERTIFICATE OF CORRECTION

PATENT NO. : 4,770,925

DATED : September 13, 1988

INVENTOR(S) : Akihiko Uchikawa, et. al.

It is certified that error appears in the above-identified patent and that said Letters Patent is hereby corrected as shown below:

lines 12 to 13, delete "bis[3,3-bis(4'-hydroxy-3'-t-butylphenyl) butric acid]glycol ester,";

lines 13 to 14, change "diphenyl-4-hydroxy-stearyl ester" to --di-t-butyl-4-hydroxyphenyl-stearyl ester--;

lines 15 to 16, change "(3,5-di-t-butyl-4-hydroxyl) to --(3'-5'-di-t-butyl-4'-hydroxyphenyl)--;

lines 25 to 26, change "di-cetyl-thio-di-propionate to --di-cetyl-3,3'-thio-di-propionate--;

lines 27 to 29, change "bis[2-methyl-4-(3-n-alkyl-thio-propionyloxy)" to --bis[2-methyl-4- 3-n-alkyl-C12 C14-thio-propionyloxy --;

line 29, after "-thiopropionate)" insert --,-- and change "di-octadecyl sulfide" to --di-octadecyl-di-sulfide--.

Columns 9 and 10, under the TABLE 1 in the first line of the "(Note)" change "tetrakis[methylene-3-(3,5-di-t-butyl-4-hydroxyl) propionate]methane" to --tetrakis[methylene-3-(3',5'-di-t-butyl-4'-hydroxyphenyl)propionate]methane--.

Column 17, claim 8, lines 3 to 5, change "tetrakis[methylene-(3,5-di-t-butyl-4-hydroxyl)propionate]methane, tris(3,5-di-t-butyl-4-" to --tetrakis[methylene-3-(3',5'-di-t-butyl-4'-hydroxyphenyl) propionate]methane, n-octadecyl-β-[4'-hydroxy-3',

UNITED STATES PATENT AND TRADEMARK OFFICE

CERTIFICATE OF CORRECTION

PATENT NO. : 4,770,925

DATED : September 13, 1988

INVENTOR(S) : Akihiko Uchikawa, et. al.

It is certified that error appears in the above-identified patent and that said Letters Patent is hereby corrected as shown below:

5'-di-t-butylphenyl)propionate, tris(3,5-di-t-butyl-4- --.

Column 18, claim 15, line 1, change "fused" to --bonded--.

Signed and Sealed this

Eleventh Day of April, 1989

*Attest:*

*Attesting Officer*

DONALD J. QUIGG

*Commissioner of Patents and Trademarks*